US007771545B2

(12) United States Patent
Johnson et al.

(10) Patent No.: US 7,771,545 B2
(45) Date of Patent: Aug. 10, 2010

(54) AMORPHOUS METAL ALLOY HAVING HIGH TENSILE STRENGTH AND ELECTRICAL RESISTIVITY

(75) Inventors: Francis Johnson, Clifton Park, NY (US); Luana E. Iorio, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 777 days.

(21) Appl. No.: 11/786,532

(22) Filed: Apr. 12, 2007

(65) Prior Publication Data

US 2010/0006185 A1 Jan. 14, 2010

(51) Int. Cl.
*C22C 45/04* (2006.01)

(52) U.S. Cl. ..... 148/304; 148/403

(58) Field of Classification Search ..... 148/403
See application file for complete search history.

(56) References Cited

U.S. PATENT DOCUMENTS

| | | | | |
|---|---|---|---|---|
| 3,856,513 | A | 12/1974 | Chen et al. | |
| 4,038,073 | A | 7/1977 | O'Handley et al. | |
| 4,056,411 | A | 11/1977 | Chen et al. | |
| 4,188,211 | A | 2/1980 | Yamaguchi et al. | |
| 4,225,339 | A | 9/1980 | Inomata et al. | |
| 4,411,716 | A | 10/1983 | Shiiki et al. | |
| 4,420,348 | A | 12/1983 | Shiiki et al. | |
| 4,439,253 | A | 3/1984 | Ramanan | |
| 4,473,417 | A | 9/1984 | Inomata et al. | |
| 4,482,400 | A | 11/1984 | O'Handley | |
| 4,495,691 | A * | 1/1985 | Masumoto et al. | 29/527.5 |
| 4,566,917 | A | 1/1986 | O'Handley | |
| 4,657,604 | A * | 4/1987 | Ogasawara et al. | 148/304 |
| 4,668,310 | A | 5/1987 | Kudo et al. | |
| 4,755,239 | A | 7/1988 | O'Handley | |
| 4,859,256 | A * | 8/1989 | Sawa et al. | 148/304 |
| 4,863,526 | A | 9/1989 | Miyagawa et al. | |
| 4,938,267 | A | 7/1990 | Hasegawa | |
| 5,037,494 | A | 8/1991 | Hilzinger et al. | |
| 5,151,137 | A | 9/1992 | Yoshizawa et al. | |
| 5,200,002 | A | 4/1993 | Hilzinger | |
| 5,539,380 | A | 7/1996 | Hasegawa et al. | |
| 5,567,537 | A | 10/1996 | Yoshizawa et al. | |
| 5,628,840 | A | 5/1997 | Hasegawa | |
| 5,650,023 | A | 7/1997 | Hasegawa et al. | |
| 5,757,272 | A | 5/1998 | Herzer et al. | |
| 5,821,129 | A | 10/1998 | Grimes et al. | |
| 6,093,261 | A | 7/2000 | Hasegawa et al. | |
| 6,239,594 | B1 | 5/2001 | Naito et al. | |
| 6,270,591 | B2 | 8/2001 | Chiriac et al. | |
| 6,559,808 | B1 | 5/2003 | Petzold et al. | |
| 6,580,348 | B1 | 6/2003 | Hundt et al. | |
| 7,223,310 | B2 * | 5/2007 | Inoue | 148/304 |
| 2001/0001397 | A1 | 5/2001 | Chiriac et al. | |
| 2002/0189718 | A1 | 12/2002 | Yoshizawa | |

FOREIGN PATENT DOCUMENTS

| | | | |
|---|---|---|---|
| EP | 0021101 | B1 | 1/1983 |
| WO | WO 00/57147 | A1 | 9/2000 |

OTHER PUBLICATIONS

G. M. Pharr, Measurement of Mechancial Properties by Ultra-Low Load Indentation, Materials Science and Engineering, 1998, p. 151-159, vol. A253, Elsevier Science.

* cited by examiner

*Primary Examiner*—George Wyszomierski
(74) *Attorney, Agent, or Firm*—James W. Pemrick; Ernest G. Cusick; Frank A. Landgraff

(57) ABSTRACT

An amorphous metal alloy having high tensile strength and high electrical resistivity is provided. The amorphous metal alloy has the following chemical composition, in atomic percent: $(Co_{1-a}Fe_a)_{100-b-c-d}Cr_bT_cX_d$, where, T is at least one element selected from the group consisting of Mn, Mo, and V; X is at least one element selected from the group consisting of B, Si and P, and a, b, c and d satisfy the formulas of: $0 \leqq a \leqq 100$, $4 \leqq b \leqq 25$, $0 \leqq c \leqq 40$, $15 \leqq d \leqq 35$, respectively. An amorphous metal alloy is obtained having a tensile strength greater than 3500 MPa, and an electrical resistivity greater than 145 μΩ-cm.

17 Claims, No Drawings

AMORPHOUS METAL ALLOY HAVING HIGH TENSILE STRENGTH AND ELECTRICAL RESISTIVITY

BACKGROUND OF THE INVENTION

This invention relates generally to amorphous metal alloys. In particular, the invention relates to cobalt or iron-based amorphous metal alloys having high tensile strength and high electrical resistivity.

An amorphous material has a disordered atomic-scale structure. In contrast, crystalline material has a highly ordered arrangement of atoms. Therefore, amorphous materials are non-crystalline. Amorphous metals are typically an alloy rather than a pure metal. These amorphous metal alloys contain atoms of significantly different sizes, leading to low free volume (and therefore up to orders of magnitude higher viscosity than other metals and alloys) in molten state. The high viscosity prevents the atoms from moving enough to form an ordered lattice. The disordered atomic-scale structure also results in low shrinkage during cooling. The absence of grain boundaries in amorphous materials, the weak spots of crystalline materials, leads to better resistance to corrosion.

Amorphous alloys have a variety of potentially useful properties. In particular, they tend to be stronger than crystalline alloys of similar chemical composition. Amorphous metals derive their strength directly from their non-crystalline structure, which does not have any of the defects (such as dislocations) that limit the strength of crystalline alloys.

Amorphous metal wires of small diameter (e.g., 5-150 microns), also referred to as microwires, can be produced by the Taylor-Ulitovsky production process, in which a glass tube and the desired metal are brought into a high-frequency induction field. The metal is melted, and its heat softens the glass tube, so that a thin metal filled capillary is drawn from the softened glass tube. The metal-filled capillary enters a cooling zone in a superheated state where it is rapidly cooled, such that the desired amorphous structure is obtained. In this process, the alloy melt is rapidly solidified in a softened glass sheath. The presence of the softened glass sheath dampens instability in the alloy melt and promotes the formation of a glass-coated microwire with uniform diameter and a smooth metal-glass interface. Rapid cooling is typically required to obtain amorphous structures. The rate of cooling is not less than $10^4$ degrees C./sec and preferably is $10^5$ to $10^6$ degrees C./sec.

In the past, crystalline metal alloys have been used in radiation detectors. One type of radiation detector is a proportional counter, and this type of detector is often used for neutron detection. A typical proportional counter includes a substantially cylindrical cathode tube, and an anode wire that extends through the cathode tube. The anode wire is very thin, approximately 5-25 microns in diameter, and should have a high electrical resistance. The cathode tube is sealed at both ends, and may be filled with a gas, such as Helium-3 gas. This gas is ionized when irradiated by incident radiation. The anode wire is insulated from the cathode and is typically maintained at a positive voltage while the cathode is at ground.

During use, incident radiation, such as neutrons, interacts with the gas inside the cathode and produces charged particles that ionize the gas atoms and produce electrons. The electrons are drawn to and strike the positive anode wire and create a current pulse that can be detected. The magnitude of the current pulse is proportional to the energy liberated in the ionization event (i.e., a neutron interacting with the ionizable gas).

In some applications proportional counters can be used as position sensitive detectors in which the location of the arriving ionized electron is determined from either the difference in the rise times of current pulses at opposite ends of the wire or from the relative amounts of charge reaching the ends. The spatial resolution of the position sensitive detector is enhanced by increasing the electrical resistance of the anode wire, which slows down the current pulses, increasing the time for the control electronics to detect the current pulses. Accordingly, high resistance anode wires are preferred to improve the spatial detection resolution of position sensitive detectors.

Radiation detectors, proportional radiation counters and neutron detectors are often used in harsh environments. The detectors can be exposed to extreme low and high temperatures, to low or high frequency vibrations and to corrosive environments. Designing a very thin anode wire to survive in these environments can be a challenge. The anode wire preferably should have high electrical resistivity (for good spatial resolution), a smooth surface finish (for uniform resistance over it's length), corrosion resistance (for harsh environments), and high tensile strength (to eliminate deleterious effects due to unwanted vibrations).

The anode wire is placed under tension during assembly of the radiation detector, and the wire must survive the manufacturing process as well as thermal and mechanical stress imparted during service. Crystalline metal alloys used as anode wires have low tensile strength and plastically deform once their tensile strength is exceeded. The failure of the anode wire and/or a change in its dimensions due to plastic deformation degrades the operation of the radiation detector. Additionally, when the radiation detector is used in some applications, it is desirable to render the radiation detector insensitive to low frequency vibrations. Typically, this is achieved by placing the anode wire under high mechanical tension. Unfortunately, crystalline metal alloys experience a high failure rate and a short service life. Accordingly, a need exists in the art for an anode wire that has high electrical resistivity, a smooth surface finish, good corrosion resistance and high tensile strength.

BRIEF DESCRIPTION OF THE INVENTION

In one aspect of the present invention, an amorphous metal alloy is provided having a chemical composition represented by the following general formula, by atomic percent: $(Co_{1-a}Fe_a)_{100-b-c-d}Cr_bT_cX_d$, where, T is at least one element selected from the group consisting of Mn, Mo, and V; X is at least one element selected from the group consisting of B, Si and P, and a, b, c and d satisfy the formulas of: $0 \leqq a \leqq 100$, $4 \leqq b \leqq 25$, $0 \leqq c \leqq 40$, $15 \leqq d \leqq 35$, respectively, and where the amorphous metal alloy has a tensile strength greater than 3500 MPa, and an electrical resistivity greater than 145 μΩ-cm.

In another aspect of the present invention, an amorphous metal alloy is provided having a composition of the formula: $Co_aFe_bCr_cSi_dB_e$, where, Co is cobalt, Fe is iron, Cr is chromium, Si is silicon and B is boron, and a, b, c, d, and e represent the atomic percent of Co, Fe, Cr, Si and B respectively, and have the following values: $20 \leqq a \leqq 50$, $1 \leqq b \leqq 10$, $4 \leqq c \leqq 25$, $5 \leqq d \leqq 12$, $10 \leqq e \leqq 20$, and $a+b+c+d+e=100$.

In yet another aspect of the present invention, an amorphous metal alloy is provided having a composition of the formula: $Co_aFe_bCr_cSi_dB_eT_f$, where, Co is cobalt, Fe is iron, Cr is chromium, Si is silicon and B is boron, T is at least one element selected from the group comprised of manganese (Mn), molybdenum (Mo) and vanadium (V), and a, b, c, d, e and f represent the atomic percent of Co, Fe, Cr, Si, B and T respectively, and have the following values: $20 \leqq a \leqq 50$, $1 \leqq b \leqq 10$, $4 \leqq c \leqq 25$, $5 \leqq d \leqq 15$, $10 \leqq e \leqq 20$, $0 \leqq f \leqq 40$, and $a+b+c+d+e+f=100$.

DETAILED DESCRIPTION OF THE INVENTION

An amorphous metal alloy having improved electrical resistivity, surface finish, corrosion resistance and tensile strength can be obtained by adding additional metal elements to ferromagnetic-based alloys. Typical ferromagnetic-based alloys are iron or cobalt-based alloys. The additional metal elements can be chosen from the transition metal and metalloid elements.

Specifically, the additional metal elements include: Scandium (Sc), Titanium (Ti), Vanadium (V), Chromium (Cr), Manganese (Mn), Iron (Fe), Cobalt (Co), Nickel (Ni), Copper (Cu), Zinc (Zn), Yttrium (Y), Zirconium (Zr), Niobium (Nb), Molybdenum (Mo), Ruthenium (Ru), Rhodium (Rh), Palladium (Pd), Silver (Ag), Cadmium (Cd), Lanthanum (La), Cerium (Ce), Praseodymium (Pr), Neodymium (Nd), Samarium (Sm), Europium (Eu), Gadolinium (Gd), Terbium (Tb), Dysprosium (Dy), Holmium (Ho), Erbium (Er), Thulium (Tm), Ytterbium (Yb), Lutetium (Lu), Hafnium (Hf), Tantalum (Ta), Tungsten (W), Rhenium (Re), Osmium (Os), Iridium (Ir), Platinum (Pt), Gold (Au), Mercury (Hg).

Preferred additional metal elements, which are added to the iron or cobalt-based alloys include: chromium (Cr), manganese (Mn), molybdenum (Mo), and vanadium (V). These are non-ferromagnetic transition metal elements, and are chosen to increase the electronic, magnetic and structural disorder of the amorphous alloy. This increase in disorder is responsible for the increase in electrical resistivity (via increased electronic scattering) and an increase in tensile strength (via reduced formation of shear bands). The chosen additional metal elements can comprise 4-50 atomic percent of the alloy. The preferred additional metal elements can be added alone, or in combination, in the following ranges: chromium in 4-25 atomic percent, manganese in 10-25 atomic percent, molybdenum in 15-30 atomic percent, and/or vanadium in 15-40 atomic percent.

Metalloid elements such as Boron (B), Silicon (Si), Phosphorous (P), Carbon (C), and Germanium (Ge) are known as "glass formers", and can be used to assist in the formation of the amorphous, glassy metal state. These glass formers can be added in a range of 10-40 atomic percent of the total chemical composition. The preferred elements are boron and silicon. Boron can be present in a range of 10-20 atomic percent and a preferred range is 10-15 atomic percent. Silicon can be present in a range of 5-15 atomic percent, and a preferred range is 10-15 atomic percent. The combination of boron and silicon as glass forming elements is preferred.

In one aspect of the present invention the amorphous metal alloy has a chemical composition represented by the following general formula, by atomic percent: $(Co_{1-a}Fe_a)_{100-b-c-d}Cr_bT_cX_d$, where T is at least one element selected from the transition metals, preferably from the group consisting of Mn, Mo, and V, X is at least one element selected from the group consisting of B, Si and P, and a, b, c and d satisfy the formulas of $0 \leqq a \leqq 100$, $4 \leqq b \leqq 25$, $0 \leqq c \leqq 40$, $15 \leqq d \leqq 40$, respectively. The alloy structure is fully amorphous and non-crystalline in structure. The fully amorphous structure yields an alloy that can have high tensile strength, greater than 3500 MPa. The electrical resistivity of such an alloy can be greater than 145 μΩ-cm.

In another aspect of the present invention the amorphous metal alloy has a chemical composition represented by the following general formula, by atomic percent: $(Co_{1-a}Fe_a)_{100-b-c-d}Cr_bT_cX_d$, where T is at least one element selected from the transition metals, preferably from the group consisting of Mn, Mo, and V, T is at least one element selected from the group consisting of B, Si and P, and a, b, c and d satisfy the formulas of $5 \leqq a \leqq 25$, $4 \leqq b \leqq 25$, $20 \leqq c \leqq 40$, $15 \leqq d \leqq 30$, respectively. The alloy structure is fully amorphous and non-crystalline in structure. The fully amorphous structure yields an alloy that can have high tensile strength, greater than 4500 MPa. The electrical resistivity of such an alloy can be greater than 160 μΩ-cm.

In additional aspects of the present invention, and as representative examples only, the amorphous metal alloy can have the following chemical compositions: $Co_{46.5}Fe_4Cr_4V_{20}Si_{12}B_{13.5}$, $Co_{46.5}Fe_4Cr_{24}Si_{12}B_{13.5}$, $Co_{46.5}Fe_4Cr_4Mn_{20}Si_{12}B_{13.5}$, $Co_{46.5}Fe_4Cr_4Mo_{20}Si_{12}B_{13.5}$, $Co_{20.5}Fe_4Cr_{25}Mo_{25}Si_{12}B_{13.5}$, $Co_{26.5}Fe_4Cr_4V_{40}Si_{12}B_{13.5}$, $Co_{26.5}Fe_4Cr_4Mn_{40}Si_{12}B_{13.5}$, $Co_{68}Fe_4Cr_4P_5Si_9B_{10}$, $Co_{67}Fe_4Cr_4Si_5B_{20}$, $Co_{46.5}Fe_4Cr_4V_{10}Mn_{10}Si_{12}B_{13.5}$.

The alloy comprising $Co_{46.5}Fe_4Cr_{24}Si_{12}B_{13.5}$ was found to have good castability. In this context, good castability is defined as the ability to form long, continuous lengths of ribbon or wire. Poor castability is shown when the alloy solidifies into discrete flakes or shards that are not suitable for the application. The melting temperature of this alloy was found to be about 1,050° C. A melting temperature that is too high generally makes it difficult to fully melt the raw materials in an induction heating coil. Induction heating coils are often used in the Taylor-Ulitovsky process of forming glass-covered micro-wires. Also, if the melting point is very high, this may indicate that the alloy is away from what is considered the eutectic material composition, which usually implies poor glass formability. A lower melting point is usually preferred, and should be balanced with the desired material properties of high tensile strength, hardness and high electrical resistivity. The nanohardness of this alloy was found to be about 13.1 GPa. The nanohardness was measured using the Oliver-Pharr technique (G. M Pharr, *Materials Science and Engineering*, Vol. A253, 1998, p. 151-159). The electrical resistivity of this alloy was found to be about 163 μΩ-cm.

In another aspect of the invention the amorphous metal alloy can have a chemical composition, in atomic percent of: $Co_aFe_bCr_cSi_dB_e$, where, Co is cobalt, Fe is iron, Cr is chromium, Si is silicon and B is boron, and a, b, c, d, and e represent the atomic percent of Co, Fe, Cr, Si and B respectively, and have the following values: $20 \leqq a \leqq 50$, $1 \leqq b \leqq 10$, $4 \leqq c \leqq 25$, $5 \leqq d \leqq 12$, $10 \leqq e \leqq 20$, and $a+b+c+d+e=100$.

In still another aspect of the invention, the amorphous metal alloy can have a chemical composition of: $Co_aFe_bCr_cSi_dB_eT_f$, where T is at least one element selected from the group comprised of manganese (Mn), molybdenum (Mo) and vanadium (V), and a, b, c, d, e and f represent the atomic percent of Co, Fe, Cr, Si, B and T respectively, and have the following values: $20 \leqq a \leqq 50$, $1 \leqq b \leqq 10$, $4 \leqq c \leqq 25$, $5 \leqq d \leqq 15$, $10 \leqq e \leqq 20$, $0 \leqq f \leqq 40$, and $a+b+c+d+e+f=100$.

Tensile strength is a very important characteristic for small diameter wires. Radiation detectors often utilize anode wires in the 5-50 micron diameter range. In some applications, the wires may range from 1-100 microns in diameter. It is critical to the accuracy of the detector that these anode wires have a constant diameter over their length. A wire having a constant diameter along its length results in the wire having a constant resistance along its length. A constant resistance is preferred for accurate spatial resolution. Another advantage to high tensile strength is the resistance to plastic deformation. As load is applied to the wire, in the form of constant tensile force, the wire should resist plastic deformation. If the wire plastically deforms, it stretches and the diameter of the wire along its length becomes inconsistent. This results in inconsistent electrical resistance and poor spatial resolution. An advantageous characteristic of amorphous wires is the absence of plastic deformation prior to fracture when loaded. A wire having a tensile strength of 3,500 MPa or greater will, resist deformation, maintain its cross-sectional diameter, be robust in harsh environments and will be able to survive the manufacturing process (particularly for longer anode wires).

Electrical resistance is also a very important characteristic for small diameter wires used in radiation detectors. In position sensitive radiation detectors, the location of an arriving neutron on the anode wire is determined by the difference in arrival times of electrical pulses at opposite terminals of the anode wire. As the electrical resistance of the anode wire increases, the speed at which the electrical pulses travel along the anode wire decreases. This increases the differential of arrival times at the ends of the anode wire, thereby enabling the detector control electronics to have increased spatial resolution when determining the location of the arriving neutron. A detector fabricated with an anode wire having an electrical resistivity of greater than 145 μΩ-cm, with greater than 160 μΩ-cm preferred, will have excellent spatial resolution.

Amorphous metal alloy wires having high tensile strength and high electrical resistivity have many advantages over crystalline metal alloy wires. The improved tensile strength allows wires with smaller diameters to be used. Wires with smaller diameters have higher resistances. Higher resistance wires are very beneficial in radiation detectors and drastically improve the spatial resolution of the detectors. Some radiation detectors require anode wires up to 4 meters or more in length, and having a wire with high tensile strength to resist breakage and/or plastic deformation is critical in these applications.

While the invention has been described in terms of various specific embodiments, those skilled in the art will recognize that the invention can be practiced with modification within the spirit and scope of the claims.

What is claimed is:

1. An amorphous metal alloy having a composition of the formula:

$$Co_aFe_bCr_cSi_dB_e$$

wherein, Co is cobalt, Fe is iron, Cr is chromium, Si is silicon and B is boron, and a, b, c, d, and e represent the atomic percent of Co, Fe, Cr, Si and B respectively, and have the following values:

$20 \leqq a \leqq 50$
$1 \leqq b \leqq 10$
$4 \leqq c \leqq 25$
$5 \leqq d \leqq 12$
$10 \leqq e \leqq 20$
$a+b+c+d+e=100$.

2. An amorphous metal alloy as defined in claim 1, said amorphous metal alloy having a tensile strength greater than 3500 MPa.

3. An amorphous metal alloy as defined in claim 1, said amorphous metal alloy having an electrical resistivity greater than 145 μΩ-cm.

4. An amorphous metal alloy as defined in claim 1, said amorphous metal alloy having a tensile strength greater than 4500 MPa, and an electrical resistivity greater than 160 μΩ-cm.

5. An amorphous metal alloy having a composition of the formula:

$$Co_aFe_bCr_cSi_dB_eT_f$$

wherein, Co is cobalt, Fe is iron, Cr is chromium, Si is silicon, B is boron and T is at least one element selected from the group comprised of manganese (Mn), molybdenum (Mo) and vanadium (V), and a, b, c, d, e and f represent the atomic percent of Co, Fe, Cr, Si, B and T respectively, and have the following values:

$20 \leqq a \leqq 50$
$1 \leqq b \leqq 10$
$4 \leqq c \leqq 25$
$5 \leqq d \leqq 12$
$10 \leqq e \leqq 20$
$10 \leqq f \leqq 40$, and
$a+b+c+d+e+f=100$.

6. An amorphous metal alloy as defined in claim 5 having a tensile strength greater than 3500 MPa.

7. An amorphous metal alloy as defined in claim 5 having an electrical resistivity greater than 145 μΩ-cm.

8. An amorphous metal alloy as defined in claim 5 having a tensile strength greater than 4500 MPa, and an electrical resistivity greater than 160 μΩ-cm.

9. An amorphous metal alloy having a composition of the formula:

$$Co_aFe_bCr_cSi_dB_eT_f$$

wherein, Co is cobalt, Fe is iron, Cr is chromium, Si is silicon and B is boron, T is at least one element selected from the group comprised of manganese (Mn), molybdenum (Mo) and vanadium (V), and a, b, c, d, e and f represent the atomic percent of Co, Fe, Cr, Si, B and T respectively, and have the following values:

$20 \leqq a \leqq 50$
$1 \leqq b \leqq 10$
$4 \leqq c \leqq 25$
$5 \leqq d \leqq 15$
$10 \leqq e \leqq 20$
$0 \leqq f \leqq 40$
$a+b+c+d+e+f=100$.

10. An amorphous metal alloy as defined in claim 9 having a tensile strength greater than 3500 MPa.

11. An amorphous metal alloy as defined in claim 9 having an electrical resistivity greater than 145 μΩ-cm.

12. An amorphous metal alloy as defined in claim 9 having a tensile strength greater than 4500 MPa, and an electrical resistivity greater than 160 μΩ-cm.

13. An amorphous metal alloy as defined in claim 12, further comprising from about 40 to about 50 atomic percent cobalt, from about 1 to about 5 atomic percent iron, from about 10 to about 15 atomic percent silicon, from about 10 to about 15 atomic percent boron and from about 10 to about 40 atomic percent of at least one element selected from the group comprised of manganese (Mn), molybdenum (Mo) and vanadium (V).

14. An amorphous metal alloy as defined in claim 9, having the composition: $Co_{46.5}Fe_4Cr_{24}Si_{12}B_{13.5}$, and having a tensile strength greater than 4500 MPa, and an electrical resistivity greater than 160 μΩ-cm.

15. An amorphous metal alloy as defined in claim 9, having the composition: $Co_{46.5}Fe_4Cr_4Mn_{20}Si_{12}B_{13.5}$, and having a tensile strength greater than 4500 MPa, and an electrical resistivity greater than 160 μΩ-cm.

16. An amorphous metal alloy as defined in claim 9, having the composition: $Co_{46.5}Fe_4Cr_4V_{20}Si_{12}B_{13.5}$, having a tensile strength greater than 4500 MPa.

17. An amorphous metal alloy as defined in claim 9, having the composition: $Co_{26.5}Fe_4Cr_4V_{40}Si_{12}B_{13.5}$, having a tensile strength greater than 4500 MPa.

* * * * *